United States Patent [19]

Sestrap

[11] Patent Number: 4,798,530

[45] Date of Patent: Jan. 17, 1989

[54] NOZZLE ASSEMBLY FOR HOT AIR TORCH

[76] Inventor: Arvo M. Sestrap, 212-1521 Blackwood Street, White Rock, B.C., Canada, V4B 3V6

[21] Appl. No.: 40,875

[22] Filed: Apr. 21, 1987

[51] Int. Cl.[4] ..... F23D 13/62

[52] U.S. Cl. ..... 431/354; 431/284; 431/2; 431/12; 431/127

[58] Field of Search ..... 431/354, 284, 127, 2, 431/12

[56] References Cited

U.S. PATENT DOCUMENTS

| | | | |
|---|---|---|---|
| Re. 28,665 | 12/1975 | Zagoroff . | |
| 316,059 | 4/1885 | Randol . | |
| 2,107,365 | 2/1938 | Bray . | |
| 3,156,454 | 11/1964 | Flynn . | |
| 3,851,050 | 11/1974 | Groenendaal et al. . | |
| 4,082,497 | 4/1978 | Crawford et al. . | |
| 4,408,984 | 10/1983 | Förster | 431/354 |
| 4,416,613 | 11/1983 | Barisoff . | |
| 4,427,367 | 1/1984 | Yagisawa | 431/354 |
| 4,462,795 | 7/1984 | Vosper et al. . | |
| 4,585,409 | 4/1986 | Pryor | 431/354 X |

OTHER PUBLICATIONS

Nordic Jet/Air 300 Sales Sheet.

Nordik Jet/Air 60 Hot Compressed Air Torch Sales Sheet.

Anderson & Forrester Orifices and Gas Conversion Fittings—Catalog No. 25 (1 title page and 3 pages showing various fittings).

Turner Liberty Refillable Torch—Owner's Manual and copies of pp. 8 and 9 of that publication.

The Goss "Gas Equipment Products" (introductory page and 3 pages showing various products).

*Primary Examiner*—Larry Jones

*Attorney, Agent, or Firm*—Hughes, Cassidy & Multer

[57] ABSTRACT

A nozzle assembly for use in a hot air torch wherein the hot air torch utilizes a source of compressed air and a source of gaseous fuel. The hot air torch has a handle portion which holds a first pipe carrying pressurized air and a second pipe carrying propane under pressure. The first pipe containing pressurized air splits into two passageways, each passageway having a valve with which flow can be regulated. As propane travels through the second pipe to an exhaust outlet nozzle, pressurized air travels into a burner tube and an annular plenum surrounding the burner tube. The burner tube has circumferentially spaced openings. The compressed air from the plenum goes through the openings and travels radially inwardly toward the exhaust nozzle. The exhaust nozzle has a generally frusto-conical shaped exterior side surface to present a frusto-conical surface against which air jets from the circumferentially spaced openings in the burner tube impinge. The frusto-conical side surface and the radially inwardly positioned air jets cause the air to converge with and impinge upon the nozzle. Air in a swirling motion mixes effectively with the gaseous fuel providing rapid combustion at a position upstream from the nozzle.

12 Claims, 3 Drawing Sheets

16
14
11
8
10
16
27
14
18
56
58
22
30
20
28
50
43
38
48
44
45a
54
32
54
34
34
32
22
30
20

NOZZLE ASSEMBLY FOR HOT AIR TORCH

BACKGROUND OF THE INVENTION (a) Field of the Invention

The present invention relates generally to a hot air torch and in particular to a nozzle assembly for a hot air torch.

(b) Background Art

Hot air torches which have a handle portion and a nozzle portion are already known in the prior art. At the handle portion, a first pipe carries pressurized air, and a second pipe carries propane gas under pressure. The first pipe carrying pressurized air leads into a block which splits the air into first and second air passageways. The passageways each have a valve by which flow can be regulated. The propane that travels through the second pipe passes through a conduit, and it is directed to a fuel exhaust outlet defined by a fuel discharge nozzle. The pressurized air from the first passageway travels into another passageway portion, and then into an annular plenum which surrounds an inner burner tube or housing. The burner tube has at its rear end circumferentially spaced radially inwardly directed air jet openings. The compressed air from the plenum goes through the jet openings and travels radially inwardly toward the nozzle outlet. This air then travels with the propane forward through the burner tube or housing and the air mixes with the propane. The mixture of propane and compressed air ignite within the burner tube and within a main cylindrical outer housing, and the flame travels outwardly through the main housing and also heats the air in the second air passageway. Hot exhaust gases proceed from the front opening of the main housing and compressed air flows through the exhaust outlet nozzle for the second air passageway.

In the prior art torch described above, there was provided a discharge nozzle of conventional design, where the lateral surfaces of the discharge nozzle were longitudinally aligned in the pattern of a regular hexagon. While the hot air torch generally served its primary function of supplying heat from the combustion products in the main housing, and also heating the high velocity air traveling through the second passageway, it was felt that there was need for improvement. This led to the development of the present invention which is an improved nozzle assembly for such a hot air torch.

A search of the U.S. patent literature has disclosed a number of prior art patents, these being the following:

U.S. Pat. No. 4,462,794 to Vosper et al. discloses a method of operating a wall-fired duct heater and a burner in which the various air paths enter radially to the axis of the fuel feed.

U.S. Pat. No. 4,416,613 to Barisoff discloses a blow pipe type of burner in which there is an axially extending burner tube connected to a mixing chamber. There are radial air inlet openings that allow air to enter a fuel air mixing chamber and air for cooling is supplied to a space in front of the burner. The improvement of Barisoff is a self cooling shield.

U.S. Pat. No. 4,082,497 to Crawford et al. teaches a high capacity quiet burner for a hot air heating system which has an open outlet end and a closed inlet end, and a secondary air flow over the burner area is provided to a space where the secondary air and the flame exhaust mix. This provides a quiet combustion process in which it is alleged that there is uniform and stable combustion.

U.S. Pat. No. 3,851,050 to Groenendaal et al. discloses a sulphur dioxide burner with a radial oxygen feed.

U.S. Pat. No. 3,156,452 to Flynn teaches a heater with a radial air feed wherein air enters behind rather than in front of the fuel nozzle.

U.S. Pat. No. 2,107,365 to Bray discloses a burner in which air enters the burner chamber and by radial openings and additional air to be heated enters a second chamber through the radial openings.

U.S. Pat. No. 1,172,755 to Wilson shows an oil burner in which air is fed radially both behind the fuel feed, and in the combustion chamber.

U.S. Pat. No. 316,059 to Randol shows a burner with a combustion chamber having air openings.

U.S. Pat. No. Re. 28,665 to Zagoroff discloses a heat gun with air at both the flame area and the secondary mixing area that is radially fed.

SUMMARY OF THE INVENTION

The present invention provides an improvement in conventional hot air torches wherein the hot air torch utilizes a source of compressed air and a source of gaseous fuel. The present improvement is in the combination of the annular air discharge structure which has a plurality of radially inwardly directed air jet openings with a nozzle having a frusto-conical exterior side surface such that the air streams discharged from the air discharge structure through the air jet openings converge at and impinge upon the frusto-conical exterior side surface of the nozzle to provide effective mixing of the fuel and air with faster, more efficient combustion so that the gaseous fuel burns at a location further upstream (i.e. closer to the nozzle) than conventional hot air torches.

A method is also disclosed of providing effective combustion in a hot air torch with a nozzle assembly, wherein the nozzle assembly has a longitudinal center axis, a front end and a back end and wherein the hot air torch utilizes a source of compressed air and a source of gaseous fuel. The method comprises the steps of providing a base structure, providing a circumferential housing which defines a primary combustion chamber, providing a nozzle member, and positioning the nozzle member at the rear end of the primary combustion chamber and centering the nozzle member on the longitudinal axis of the nozzle member. The nozzle member has a center through opening which faces from the nozzle in a forward direction and the nozzle member is characterized in that it has a generally frusto-conical exterior side surface which slopes inwardly and forwardly to terminate at the front end of the center through opening of the nozzle. Fuel is discharged in a forward direction through the combustion chamber. An annular air discharge structure is provided which defines an annular plenum to receive pressurized air and the air discharge structure has a plurality of radially inwardly directed air jet openings positioned circumferentially around the nozzle member to direct air from the plenum through the air jet openings towards the nozzle member. The annular air discharge structure is positioned at the rear end of the housing and the nozzle member and the air discharge structure are positioned such that air jets discharged from the air jet openings converge at and impinge upon the frusto-conical exterior side surface of the nozzle member. Air flows from the air discharge structure through the air jet openings in a radially inwardly direction towards the nozzle member and gaseous fuel flows from the source of gaseous fuel. As air strikes the frusto-conical exterior side surface of the nozzle member and combines effectively with the gaseous fuel to mix the air with the fuel, effective combustion is provided at a location downstream from the nozzle member.

It is therefore an object and advantage of the present invention to provide a nozzle configuration in combination with an air discharge structure to provide faster more efficient and effective combustion.

It is a further object and advantage of the present invention to provide substantially complete combustion at a location further upstream toward the nozzle than conventional hot air torches.

It is still another object and advantage of the present invention to provide a hot air torch where in normal practice no actual flame exits from the outer housing member.

DESCRIPTION OF THE PREFERRED EMBODIMENT

Figures 1, 2:
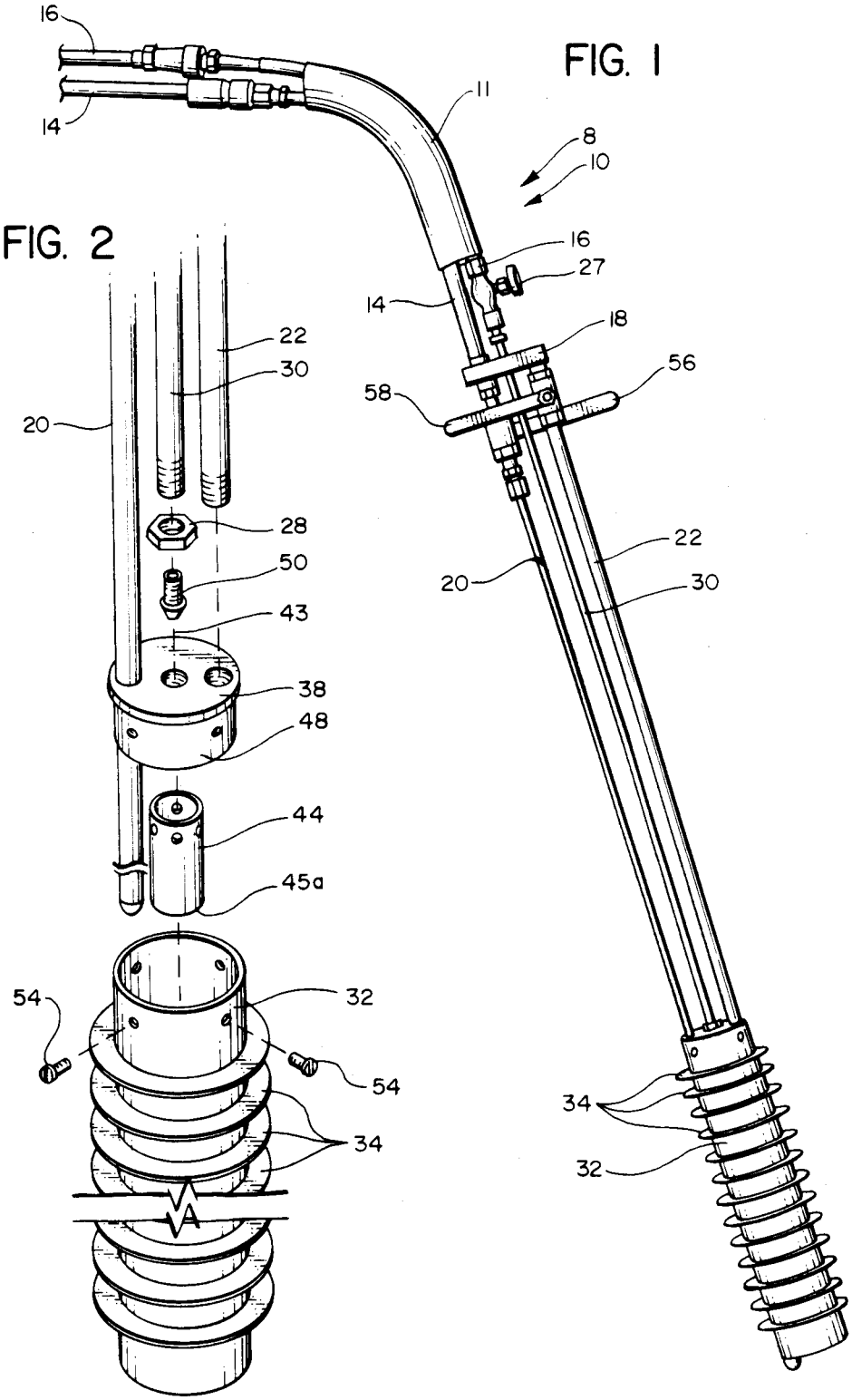
FIG. 1 is an isometric view of a hot air torch particularly adapted to incorporate the nozzle assembly of the present invention.
FIG. 2 is an isometric exploded view of the lower end portion of the torch of FIG. 1.

Referring now to the drawings in general and in particular to FIG. 1 of the drawings, there is shown a side elevational view of a hot air torch shown generally by the numeral 8. The hot air torch 8 has a handle portion shown generally by the number 10 which has an air pipe 14 which is a source of compressed air and a propane pipe 16 which is a source of gaseous fuel which both lead into and are covered by the handle 11. The air pipe 14 and the propane pipe 16 exit from the handle 11 and propane pipe 16 has a valve 27 used to control the flow of the propane. The air pipe 14 connects to block 18 at which point the air pipe 14 splits into two air passageway conduits 20 and 22. The air passageway conduit 20 has a handle 56 for a valve to control the air flow through conduit 20, the air passageway conduit 22 has a corresponding handle 58 for a valve controlling the air flow through air conduit 22, and the propane pipe 16 has a valve 27 for controlling the flow of gaseous fuel. From the valve 27 for propane pipe 16, the fuel passes through fuel pipe 30 into outer burner housing 32 which has cooling fins 24. The movement of air and fuel into the outer burning housing 32 will be described in greater detail with reference to FIG. 3.

Referring now to FIG. 2, there is shown an exploded perspective view of the nozzle member as it is positioned in the hot air torch. Fuel pipe 30 extends downwardly from the handle portion 11, as shown in FIG. 1, and has an exteriorly threaded end that screws into a center opening in a plate 38. Exhaust nozzle 50 has an exteriorly threaded rear end which is threaded into fuel pipe 30, and the pipe 30 is fixedly held in position by means of a lock means 28. An inner burner housing 44 is mounted to the plate 38. Inner burner housing 44 has a lengthwise axis shown at dashed line 45 which is aligned with the longitudinal center axis of the nozzle 50 shown at line 43. The inner burner housing 44 has a cylindrical configuration with a front open end **45*a* and the inner burner housing 44 is positioned within the outer burner housing 32. The outer burner housing is attached to the mounting plate by means of screws 54. The outer burner housing 32 has its cooling fins 34 positioned annularly around outer burner housing 32**.

Figure 3:
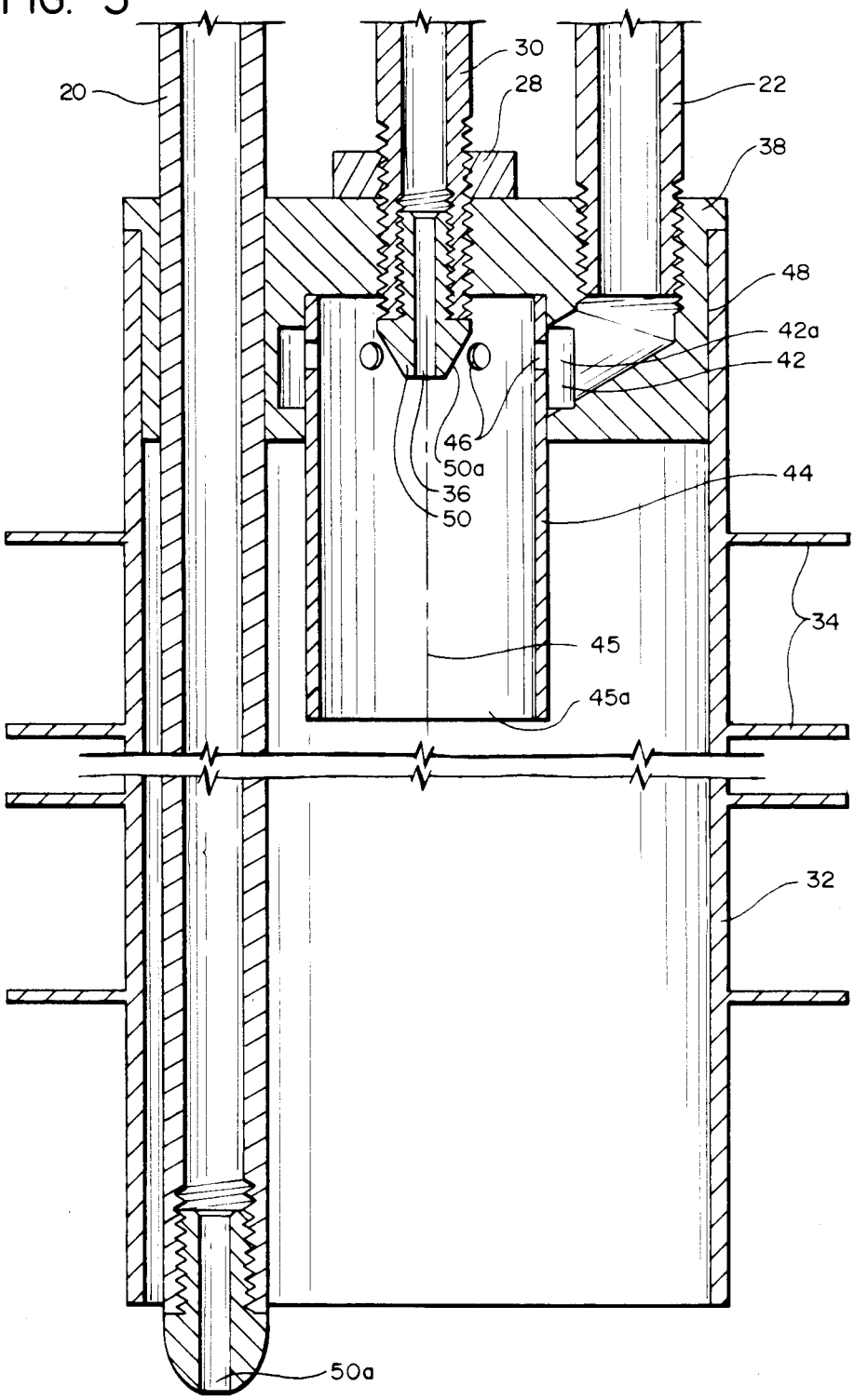
FIG. 3 is a sectional view taken through a longitudinal center axis of the nozzle assembly of the present invention.

Referring now to FIG. 3, there is shown a sectional view taken along the longitudinal centerline of the hot air torch showing the internal composition of the hot air torch. It can be seen that fuel pipe 30 leads into a longitudinally aligned central fuel discharge passageway 40 formed in the nozzle 50, from which fuel flows into the inner burner housing 44. The inner burner housing 44 has an air discharge housing 42 which is positioned entirely around the rear end of the inner burner housing 44. The air discharge housing 42 defines an annular plenum **42*a* and has a plurality of radially inwardly directed air jet openings 46 positioned circumferentially around the nozzle member 50 to direct air from the air discharge housing 42 through the air jet openings 46 towards the exhaust nozzle 50. In the preferred embodiment the air jet openings 46 are spaced evenly apart and substantially perpendicular to the longitudinal axis 43 of the exhaust nozzle 50. Exhaust nozzle 50 has an exhaust outlet 36**.

Further shown in FIG. 3, it can be seen that upper air passageway 22, lower air passageway 20 and fuel pipe 30 are all attached to rear mounting plate 38. Rear mounting plate 38 has an outside surface 48 to which is mounted the outer burner housing 32. Lower air passageway conduit 20 is shown extending into and through the outer burner housing 32. High velocity air that is discharged from the low air passageway conduit 20 at a more foreward location (i.e. just forwardly of the outer main housing 32). This high velocity air can be used, for example, to dislodge debris which is in the path of the hot combustion gasses flowing from the outer main housing 32.

With reference to FIG. 3, in operation, compressed air from the upper air passageway 22 travels through the rear mounting plate 38 into the air discharge housing 42 which entirely surrounds the rear end of the inner burner housing 44. The compressed air from the air discharge housing 42 goes through the air jet openings 46 and travels radially inwardly towards the exhaust outlet 36. Also, propane gas travels through fuel pipe 30 into the inner burner housing 44. The compressed air from the air discharge housing 42 mixes with the propane gas and moves forwardly through the inner burner housing 44. The mixture of air and propane ignites and the flame travels outwardly from the inner housing 44 and into the outer burner housing 32. As the flame travels outwardly through the outer burner housing 32, it heats the air in lower air passageway conduit 20 which is discharged at a forward location **50*a***.

It should be emphasized that the components described above are, in and of themselves, already known in the prior art. The present invention resides in the particular configuration of the exhaust nozzle 50 which, in combination with the above-described components, provides particularly effective combustion in the inner housing 44 and on into the outer housing 32.

The frusto-conical configuration of the exhaust nozzle 50 presents a frusto-conical exterior side surface **50*a* against which the air jets from the circumferentially spaced air jet openings 46 in the inner burner housing 44 impinge. It has been found that this particular arrangement causes an effective mixing of the air with the propane fuel so that combustion takes place very rapidly and efficiently, with substantially complete combustion taking place entirely within the housing 32. In this preferred embodiment, the slant of the frusto-conical surface 50a is at about 45° to the center nozzle axis 43**. However, this angle could be varied somewhat from this exact angle.

Figure 4:
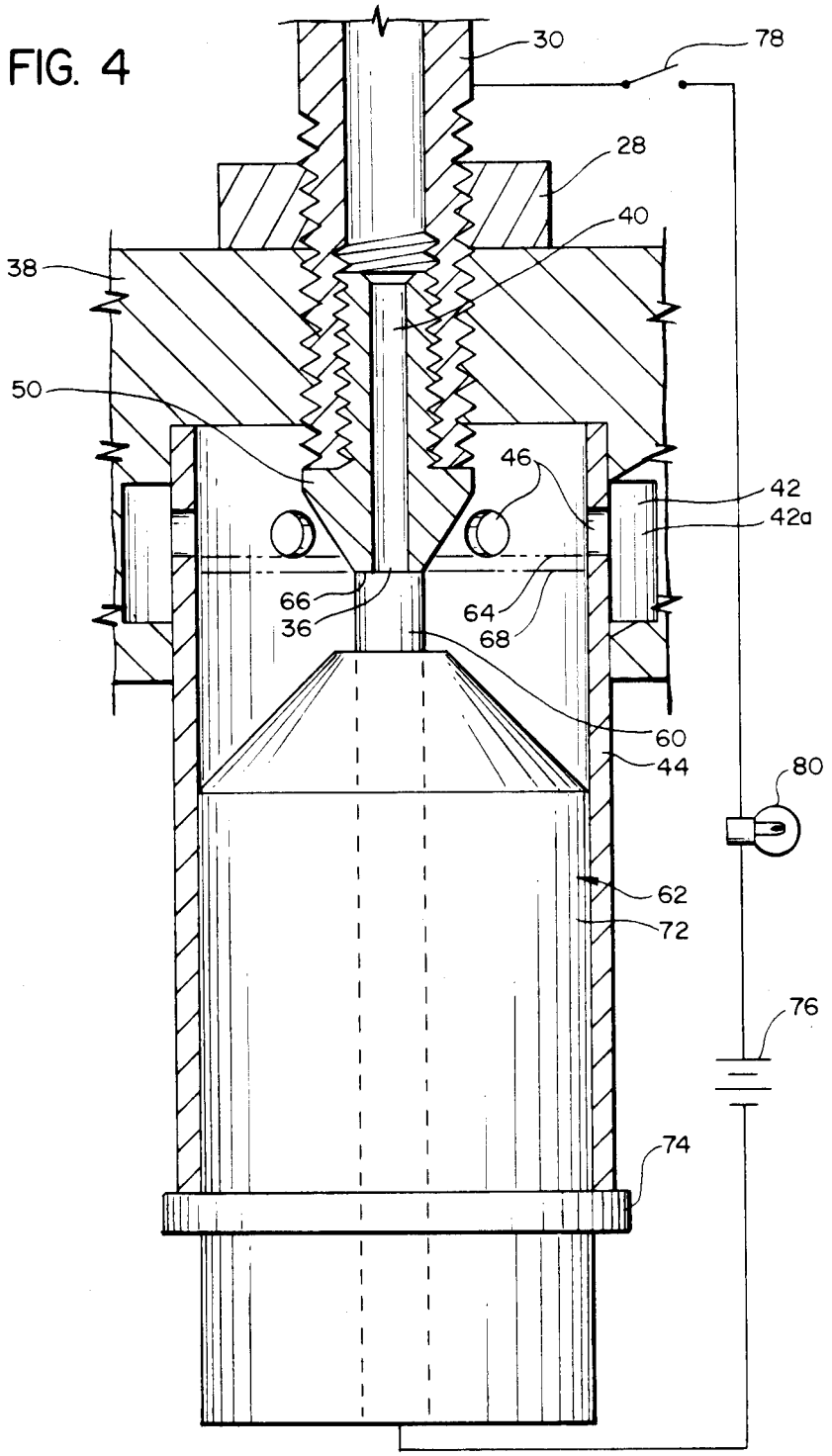
FIG. 4 is a view similar to FIG. 3, illustrating a manner in which the nozzle member of the nozzle assembly is properly positioned relative to the air jet openings.

Referring now to FIG. 4, there is shown an enlarged sectional view showing the air discharge assembly. Exhaust nozzle 50 has a front face portion 66 which is at the end of exhaust nozzle 50 and surrounds the exhaust outlet 36. Line 68 is a line coincident with the front face portion 66 of exhaust nozzle 50 and line 64 is a line which is coincident with a plane defined by the front edges of the air jet openings 46. The position of the front face portion 66 of the exhaust nozzle 50 should not be more than one half of a hundredth of an inch rearwardly nor more than one and a half hundredth of an inch forwardly of the plane defined by the front edges of the air jet openings shown at 64. In the preferred embodiment, the exhaust nozzle 50 should not be more than 0.002 inch rearwardly nor more than 0.007 inch forwardly from the front edge 64 of the air jet openings 46. Desirably the front face 66 should be coincident with the plane 64 or just 0.002 to 0.004 inch forwardly of the plane 64.

It has been found that this placement of the nozzle 50 relative to the air jet 46 is quite critical. In presenting the preferred loctation of the nozzle 50, it is to be understood that the alignment of the air jets 46 is such that the direction of the air jets emitted from the openings 46 is perpendicular to the longitudinal center axis 45. Obviously, if the radially inward direction of the flow from these air jets 46 varied from a plane perpendicular to the axis 45, the placement of the nozzle 50 would vary accordingly, so that the air jets would impinge properly on the frusto-conical nozzle surface 50a. It is believed that the effective combustion achieved by the present invention is due to the interaction of the air jets from the openings 46 at the very front end location of the nozzle 50. If the nozzle is placed too far rearwardly, there is a tendency for the high-pressure air jets to snuff out the flame, possibly by creating sufficient back pressure to inhibit the discharge of the propane fuel. Or it happens that the flame which is developed is rather erratic. On the other hand, if the nozzle 50 is placed too far forward, relative to the plane defined by the front edges of the air jet openings 46, the combustion takes place at a further downstream direction, and in operation it can be seen that flame is actually emitted from the forward open end of the main cylinder 32. On the other hand, when the front face 66 is coincident with the plane at the line 64 or just slightly forward thereof, the fuel-air mixture is optimized at a further upstream location. For each of illustration, the distance between the lines 64 and 68 in FIG. 4 is somewhat exaggerated. In actual practice, these lines 64 and 68 would be either very close to one other, or coincident with one another.

Also in the preferred embodiment, the front out face portion 66 of exhaust nozzle 50 has a diameter of about 0.218 inch, and the exhaust outlet 36 in the exhaust nozzle 50 has a diameter between 0.0930 inch to 0.0940 inch.

To properly position the nozzle 50 relative to the air jet openings 46, there is, as shown in FIG. 4, a positioning tool 62. This positioning tool 62 comprises a wooden cylindrical block 72 having a locating flange 74, and a centrally located and longitudinally aligned metallic rod-like member 60 extending through the block 72. The block 72 is placed within the inner housing 44, and an electrical connection is made between the rear end of the metal rod 60 to a battery 76 through a switch 78 back to the metallic conduit 30. The conduit 30, with the nozzle 50 already threaded therein, is screwed forwardly within the plate 38. (The lock nut 28 is at this time loose). When the front face 66 of the nozzle 50 comes into contact with the front end of the metallic rod 60, an electrical circuit is closed, and a light bulb 80 which is connected in series with the battery 76 and the switch 78 (the switch 78 being closed) will light up. After this, the lock nut 28 is threaded down tightly onto the conduit 30 to hold the conduit 30 in place.

From the foregoing, it can be seen that the applicant's nozzle configuration in the form of a generally frusto-conical shaped exterior side surface in combination with the air discharge structure which has a plurality of radially inwardly directed air jet openings provides efficient and effective combustion in a hot air torch.

It should be apparent after studying the drawings and reading the description of the preferred embodiment that other changes may be made in the arrangement of the parts and the positioning of the various structures in the assembly. The applicant is not to be limited to the exact embodiment shown which has been given by way of illustration only.

What is claimed is:

1. A nozzle assembly having a longitudinal center axis, a front end and a back end particularly adapted for use in a hot air torch wherein the hot air torch utilizes a source of compressed air and a source of gaseous fuel comprising:

(a) a base structure;

(b) a circumferential housing having a front open end and a rear end, the housing having a lengthwise axis which is aligned with the longitudinal center axis of the nozzle assembly, the housing comprising a circumferential side wall which extends around the longitudinal axis and defines a primary combustion chamber;

(c) a nozzle member located at the rear end of the housing and centered on the longitudinal axis of the nozzle assembly, the nozzle member having a front forwardly facing portion with a center through opening, the opening having a front end which faces from the nozzle member in a forward direction along the longitudinal axis of the nozzle assembly so as to discharge fuel in a forward direction through the combustion chamber, the nozzle member being characterized in that the nozzle member has a generally frusto-conical exterior side surface which slopes inwardly and forwardly to terminate at the front end of the center through opening;

(d) an annular air discharge structure located at the rear end of the housing and defining an annular plenum chamber to receive pressurized air therein, the structure having a plurality of radially inwardly directed air jet openings positioned circumferentially around the nozzle member to direct air from the plenum through the air jet openings in a converging radially inward direction toward the nozzle member; and (e) the nozzle member and the air discharge structure being positioned such that air jets discharged from the air jet openings converge at and impinge upon the frusto-conical exterior side surface of the nozzle member, with the air jets being a primary source of combustion air for the fuel discharged from the nozzle member, whereby as air is directed from the air discharge structure through the air jet openings and flows radially inwardly toward the nozzle member and as gaseious fuel flows from the nozzle opening, the air strikes the frusto-conical exterior side surface of the nozzle member in a manner that the air combines effectively with the gaseous fuel to mix the air with the gaseous fuel providing effective combustion.

2. The nozzle assembly as defined in claim 1 wherein the radially inwardly directed air jet openings are evenly spaced apart and have discharged alignment axes substantially perpendicular to the longitudinal axis of the nozzle assembly.

3. The nozzle assembly as defined in claim 2 wherein the air jet openings in the annular air discharge structure each have a front edge defining a transverse reference plane, and the front surface of the nozzle member at the center through opening of the nozzle member is positioned not more than 0.005 inch rearwardly nor more than 0.015 inch forwardly of the reference plane defined by the front edges of the air jet openings.

4. The nozzle assembly as defined in claim 3 wherein the front surface of the nozzle member is positioned not more than 0.002 inch rearwardly nor more then 0.007 inch forwardly of the reference plane defined by the front edges of the air jet openings.

5. The nozzle assembly as defined in claim 1 further comprising an outer housing positioned around the primary combustion chamber and extending further downstream therefrom.

6. The nozzle assembly as recited in claim 1, wherein said nozzle assembly is arranged so that a flow area positioned forwardly of the frusto-conical exterior side surface of the nozzle is substantially unrestricted to permit flow of the air jets to be deflected forwardly from the frusto-conical exterior side surface in a forward direction to flow substantially unobstructed into the combustion chamber.

7. A method of providing effective combustion in a hot air torch with a nozzle assembly, the nozzle assembly having a longitudinal center axis, a front end and a back end wherein the hot air torch utilizes a source of compressed air and a source of gaseous fuel, comprising the steps of:

(a) providing a base structure;

(b) providing a circumferential housing having a front open end and a rear end, the housing having a lengthwise axis which is aligned with the longitudinal center axis of the nozzle assembly, the housing comprising a circumferential side wall which extends around the longitudinal axis and defines a primary combustion chamber;

(c) providing a nozzle member;

(d) positioning the nozzle member at the rear end of the housing and centering the nozzle member on the longitudinal axis of the nozzle assembly;

(e) providing the nozzle member with a front forwardly facing portion with a center through opening, the opening having a front end which faces from the nozzle member in a forward direction, the nozzle member being characterized in that the nozzle member has a generally frusto-conical exterior side surface which slopes inwardly and forwardly to terminate at the front end of the opening;

(f) providing an annular air discharge structure defining an annular plenum chamber to receive pressurized air therein, the air discharge structure having a plurality of radially inwardly directed air jet openings positioned circumferentially around the nozzle member to direct air from the plenum through the air jet openings in a converging radially inward direction toward the nozzle member;

(g) positioning the annular air discharge structure at the rear end of the housing;

(h) positioning the nozzle member and the air discharge structure such that air jets discharged from the air jet openings converge at and impinge upon the frusto-conical exterior side surface of the nozzle member;

(i) directing air from the air discharge structure through the air jet openings whereby the air flows radially inwardly toward the nozzle member with the air jets being a primary source of combustion air for the fuel discharged from the nozzle member; and (j) directing gaseous fuel flow from the source of gaseous fuel whereby air strikes the frusto-conical exterior side surface of the nozzle member and combines effectively with the gaseous fuel to mix the air with the gaseous fuel providing effective combustion.

8. The method of providing effective combustion in a hot air torch as defined in claim 7 wherein the radially inwardly directed air jet openings are evenly spaced apart and positioned substantially perpendicular to the longitudinal axis of the nozzle assembly.

9. The method of providing effective combustion in a hot air torch as defined in claim 8 wherein the air jet openings in the annular air discharge structure each have a front edge defining a transverse reference plane, and the front surface of the nozzle member at the center through opening of the nozzle member is positioned not more than 0.005 inch rearwardly nor more than 0.015 inch forwardly of the reference plane defined by the front edges of the air jet openings.

10. The method as defined in claim 9 wherein the front surface of the nozzle member is positioned not more than 0.002 inch rearwardly nor more than 0.007 inch forwardly of the reference plane of the front edges of the air jet openings.

11. The method of providing effective combustion in a hot air torch as defined in claim 7 further comprising the steps of:

(k) providing an outer housing; and (l) positioning the outer housing around the primary combustion chamber.

12. The method as recited in claim 8, wherein said nozzle assembly is arranged so that a flow area positioned forwardly of the frusto-conical exterior side surface of the nozzle is substantially unrestricted to permit flow of the air jets to be deflected forwardly from the frusto-conical exterior side surface in a forward direction to flow substantially unobstructed into the combustion chamber.

* * * * *